US008308526B2

(12) United States Patent
Jayabalan

(10) Patent No.: US 8,308,526 B2
(45) Date of Patent: Nov. 13, 2012

(54) MASKING METHOD FOR EDGE PROFILE FINISHING

(75) Inventor: Navabalachandran Jayabalan, Singapore (SG)

(73) Assignee: Pratt & Whitney Services PTE Ltd, Singapore (SG)

( * ) Notice: Subject to any disclaimer, the term of this patent is extended or adjusted under 35 U.S.C. 154(b) by 0 days.

(21) Appl. No.: 13/338,322

(22) Filed: Dec. 28, 2011

(65) Prior Publication Data

US 2012/0094580 A1 Apr. 19, 2012

Related U.S. Application Data

(62) Division of application No. 12/045,093, filed on Mar. 10, 2008, now Pat. No. 8,105,133.

(51) Int. Cl.
*B24B 1/00* (2006.01)
*B21D 53/78* (2006.01)

(52) U.S. Cl. ..... 451/26; 29/889.7; 451/442

(58) Field of Classification Search ..... 118/213, 118/301, 406, 504, 505; 150/166; 216/41, 216/45, 46; 239/103, 104, 150, 288; 415/200; 451/29, 442; 29/889.7
See application file for complete search history.

(56) References Cited

U.S. PATENT DOCUMENTS

| | | | |
|---|---|---|---|
| 4,156,807 | A | 5/1979 | Howard |
| 4,256,444 | A | 3/1981 | Suter |
| 4,530,861 | A | 7/1985 | Sippel |
| 4,594,761 | A | 6/1986 | Murphy |
| 5,049,722 | A | 9/1991 | Corfe |
| 5,437,724 | A | 8/1995 | Dansereau |
| 5,565,035 | A | 10/1996 | Sylvestro |
| 6,037,004 | A | 3/2000 | Zajchowski et al. |
| 6,165,269 | A | 12/2000 | Kathe |
| 6,177,038 | B1 | 1/2001 | Reed |
| 6,179,387 | B1 | 1/2001 | Nasset |
| 6,183,347 | B1 | 2/2001 | Shaw |
| 6,258,226 | B1 | 7/2001 | Conner |
| 6,273,676 | B1 | 8/2001 | Brooks et al. |
| 6,296,705 | B1 | 10/2001 | Ireland et al. |
| 6,520,838 | B1 | 2/2003 | Shaw |
| 6,695,587 | B2 | 2/2004 | Wustman et al. |
| 6,913,442 | B2 | 7/2005 | Das et al. |
| 7,174,599 | B2 | 2/2007 | Stiles |
| 2003/0232139 | A1 | 12/2003 | DeTura |
| 2004/0097170 | A1 | 5/2004 | Bolz et al. |
| 2005/0100672 | A1 | 5/2005 | Stankowski et al. |
| 2005/0227589 | A1 | 10/2005 | Oussaada et al. |
| 2009/0110831 | A1 | 4/2009 | Mase et al. |

FOREIGN PATENT DOCUMENTS

| | | |
|---|---|---|
| EP | 0518102 | 12/1992 |

OTHER PUBLICATIONS

Search Report mailed Feb. 5, 2009.

*Primary Examiner* — Timothy V Eley
(74) *Attorney, Agent, or Firm* — Carlson, Gaskey & Olds, PC

(57) ABSTRACT

A mask for performing high speed media finishing on airfoils includes a thicker portion and a thinner portion. The thicker portion is spaced further from an edge that will become a leading edge in the final airfoil than the thinner portion. The media is redirected by the thicker portion toward the edge where the finishing is to occur.

2 Claims, 1 Drawing Sheet

MASKING METHOD FOR EDGE PROFILE FINISHING

RELATED APPLICATIONS

This application is a divisional of U.S. application Ser. No. 12/045,093, filed Mar. 10, 2008, which claims priority to Singapore Application No. 200800203.2, filed Jan. 9, 2008.

BACKGROUND OF THE INVENTION

This application relates to a mask for a trailing edge of an airfoil.

Airfoils, such as used as compressor blades for gas turbine engines, are in part formed with a shearing operation. The leading edge of the airfoil is initially an unprofiled blunt edge after the shearing operation.

Typically, the airfoil and the rest of the blade are placed in a high speed media finishing centrifuge. Media is directed at high speed toward the leading edge such that the initial blunt edge is formed into a smoother rounded edge in a final desired shape that helps facilitate airflow. Essentially, small stones are moved at a high speed toward the leading edge to create the rounded surface.

In the prior art, the remainder of the airfoil which does not need rounding is masked by tape. Although the tape does protect the airfoil, the tape does not serve to direct the media toward the leading edge. Instead, the thin vinyl tape only serves to protect the non-repaired area from erosion by preventing contact from media.

SUMMARY OF THE INVENTION

In the disclosed embodiment of this invention, a mask for a trailing edge of an airfoil is formed to have a slot extending from an open end inwardly to an inner end. A thicker portion of the mask is spaced further away from the open end and thinner portions are spaced toward the open end. The thicker portion of the mask serves to redirect media stones toward the leading edge, thus creating a more efficient media finishing operation.

These and other features of the present invention can be best understood from the following specification and drawings, the following of which is a brief description.

DETAILED DESCRIPTION OF THE PREFERRED EMBODIMENT

Figure 1:
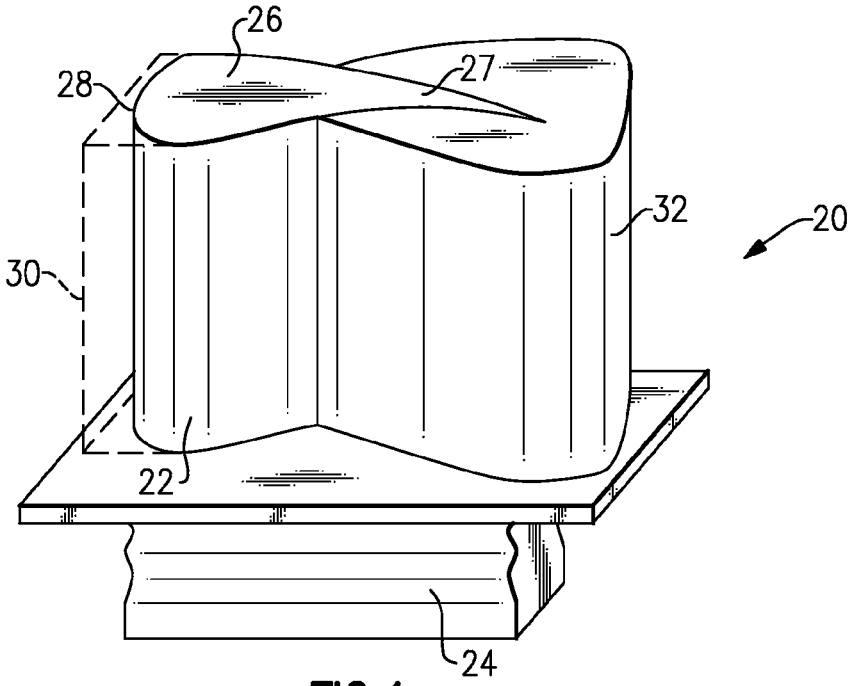
FIG. 1 is a perspective view of a blade and mask.

An exemplary blade and mask system 20 is illustrated in FIG. 1. The blade 22 has a platform and root section 24, and an airfoil 26. In a final form, the airfoil 26 has a leading edge 28 and a trailing edge 27. Initially, the airfoil 26 is formed from an initial metal medium using a shearing operation such that a blunt shearing edge 30 remains after the shearing operation. Subsequently, a media finishing operation is performed to round the shearing edge of the intermediate part to the final leading edge 28. A mask 32 is mounted on the trailing edge 27 during this tumbling operation. As shown in the figure, the blade 22 is slipped into the pre-fabricated masking "fixture" by being moved into slot 38.

Figure 2:
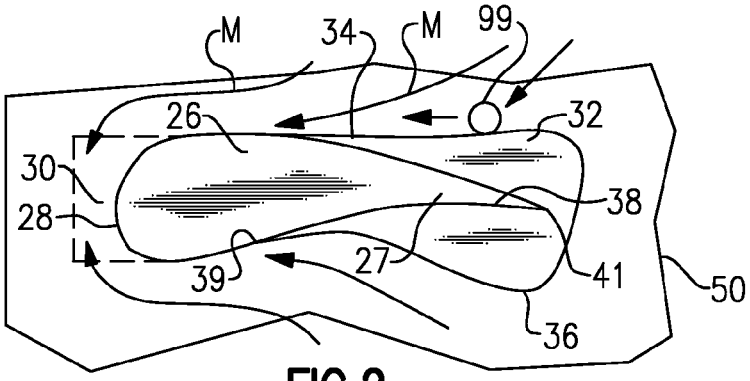
FIG. 2 is a schematic view of the mask and blade within a centrifuge.

As shown in FIG. 2, a centrifuge tumbling system 50 is used for a media finishing the airfoil 26. The mask 32 has thicker portions 36 more removed from the leading edge 28 than thinner portions 34, which are spaced toward the leading edge 28. As shown, an outer periphery surface of the mask 32 is substantially curved at the thicker portions 36 and tapers inwardly towards the thinner portions 34. The media is now directed more toward the leading edge 28 and the shearing edge 30 to be removed. As shown schematically, one media stone 99 has struck the outer periphery surface of the mask 32 adjacent to thicker portion 36. A trajectory of the stone 99 will now be changed toward the leading edge 28.

Figure 3:
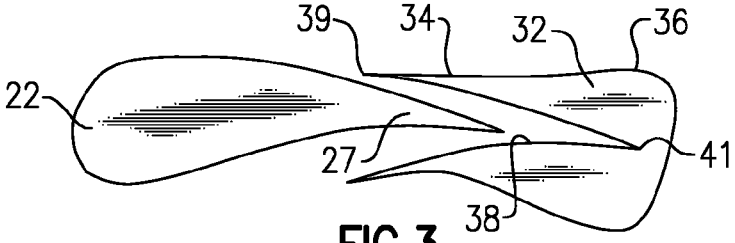
FIG. 3 shows the removal of the mask from the blade.

As can be appreciated from FIGS. 2 and 3, the slot 38 has an open end 39 extending inwardly to an inner end 41. The trailing edge 27 of the airfoil extends into the inner end 41. The thinner portions 34 can be seen to be spaced toward the open end 39 relative to the thicker portions 36. As shown in the figures, the outer profile of the mask 32 from the thicker portions 36 leading to the thinner portions 34 is curved to guide the media 99 toward the blunt edge 30 to facilitate formation of the leading edge 28. Shapes other than curves may be utilized. Further, the terms "thicker" and "thinner" are defined by the distance from the trailing edge 27 to an outer profile of the mask at the locations when the mask is received on an airfoil. While the thicker portion 36 may not redirect all of the media toward the blunt edge 30, it will serve to redirect a good deal of the media towards the edge 30.

The prior art tape, which was of a thin, uniform width, would not direct any more media toward the edge than what may have been directed in some other direction.

While a centrifuge tumbling system is disclosed, the mask can be utilized with other tumbling machines for media and stock removal and for rounding operations. As an example, vibratory tumbling machines could benefit from the disclosed mask.

As compared to typical media finishing operations, the media finishing utilizing such a mask is done much more efficiently, in that the media is concentrated on the area to be finished.

As shown in FIG. 3, once the media finishing operation is complete, the mask 32 can be easily removed from the airfoil 22. The mask 32 is preferably formed of a suitable material, such as rubber or plastic. Generally, the mask can be made of a material that is flexible enough to mount the blade, but rigid enough not to deform under the media impact. In one embodiment, a rubber material that temporarily deforms to allow mounting and returns to original shape, and maintains its shape during the process was used.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of finishing a blade having an airfoil, the method comprising the steps of:

a) providing an intermediate blade having an edge to be finished into a leading edge of the airfoil;

b) providing a mask having a slot extending from an open end to an inner end, and said mask having a thinner portion spaced toward said open end from a thicker portion, and positioning a trailing edge of said airfoil into said slot; and c) placing said mask and said airfoil into a media finishing device, and directing media at the airfoil and mask, with said thicker portion of said mask directing media toward the edge of the intermediate blade.

2. The method as set forth in claim 1, wherein said media system is a centrifuge.

* * * * *